US005699095A

United States Patent [19]

Mitsuzawa et al.

[11] Patent Number: 5,699,095

[45] Date of Patent: Dec. 16, 1997

[54] INK-JET RECORDING APPARATUS

[75] Inventors: Toyohiko Mitsuzawa; Norihiko Kurashima; Fujio Akahane, all of Nagano, Japan

[73] Assignee: Seiko Epson Corporation, Tokyo, Japan

[21] Appl. No.: 190,529

[22] Filed: Feb. 2, 1994

[30] Foreign Application Priority Data

| | | | |
|---|---|---|---|
| Feb. 2, 1993 | [JP] | Japan | HEI5-037521 |
| Mar. 31, 1993 | [JP] | Japan | HEI5-073712 |
| Jan. 14, 1994 | [JP] | Japan | P. HEI.6-015758 |

[51] Int. Cl.[6] ..... B41J 2/19

[52] U.S. Cl. ..... 347/92; 347/30; 347/93

[58] Field of Search ..... 347/86, 85, 87, 347/49, 93, 92, 30

[56] References Cited

U.S. PATENT DOCUMENTS

| | | | |
|---|---|---|---|
| 3,929,071 | 12/1975 | Cialone et al. | 101/335 |
| 3,945,021 | 3/1976 | Kraus | 346/75 |
| 4,424,521 | 1/1984 | Lewis et al. | 346/140 |
| 4,567,494 | 1/1986 | Taylor | 346/140 R |
| 4,700,202 | 10/1987 | Kuranishi et al. | 346/140 |
| 4,739,847 | 4/1988 | Terasawa | 177/140 |
| 4,771,295 | 9/1988 | Baker et al. | 346/1.1 |
| 5,138,343 | 8/1992 | Aichi et al. | 346/140 R |
| 5,341,164 | 8/1994 | Miyazawa et al. | 347/88 |
| 5,379,061 | 1/1995 | Yamaguchi et al. | 347/141 |
| 5,382,969 | 1/1995 | Mochizuki et al. | 347/30 |
| 5,495,272 | 2/1996 | Yamaguchi | 347/28 |

FOREIGN PATENT DOCUMENTS

| | | | |
|---|---|---|---|
| A10322131 | 6/1989 | European Pat. Off. | B41J 3/04 |
| 0408241A2 | 1/1991 | European Pat. Off. . | |
| 0440110A1 | 8/1991 | European Pat. Off. . | |
| 0553535A1 | 8/1993 | European Pat. Off. . | |
| 2654049 | 6/1978 | Germany . | |
| 2001324 | 1/1990 | Japan | 347/93 |
| 5050610 | 3/1993 | Japan | 347/93 |
| WO8910265 | 11/1989 | WIPO | B41J 3/04 |

OTHER PUBLICATIONS

G. Leslie et al. Stainless Stell Mesh Filter for Filtration of Magnetic Ink. p. 3421 vol. 16 No. 10 Mar. 1974.

Patent Abstracts of Japan, vol. 11, No. 10 (M–552), Feb. 10, 1987 (JP–A–61 188 155, Aug. 21, 1986).

Patent Abstracts of Japan, vol. 8, No. 244 (M–337), Nov. 9, 1984 (JP–A–59 123 691, Jul. 17, 1984).

*Primary Examiner*—Benjamin R. Fuller

*Assistant Examiner*—Thien Tran

*Attorney, Agent, or Firm*—Sughrue, Mion, Zinn, Macpeak & Seas, PLLC

[57] ABSTRACT

An ink-jet type recording apparatus including a connecting member which is provided with a first ink supply passage disposed in a carriage and extending in parallel toward a print head unit and a second ink supply passage extending upwardly and communicated with the ink tank and the first ink supply passage, an ink head unit connected to the connecting member for jetting ink droplets corresponding to print signals, a hollow needle engaging with a needle insertion hole of the ink tank, a filter member provided in parallel with a tapered concave portion formed between the hollow needle and the second ink supply passage, a cap member detachably mounted on the print head unit for communicating with a suction pump, and a control member for driving the suction pump in a first suction mode which operates intervally and a second suction mode which operates continuously.

35 Claims, 7 Drawing Sheets

INK-JET RECORDING APPARATUS

BACKGROUND OF THE INVENTION

1. Field of the Invention

The present invention relates generally to an ink-jet recording apparatus for jetting ink droplets from nozzles to record recording images such as characters, of a type in which an ink tank is mounted on a carriage.

2. Related Art

The ink-jet type recording apparatus includes a couple of types, i.e., one type where an ink tank is disposed on a suitable portion of a body and ink is supplied from the ink tank to a print head unit through an ink supply pipe such as a tube, and the other type where an ink tank is housed on a carriage on which a print head unit is mounted.

The latter type, so called an on-carriage type, has an advantage in that the ink supply pipe is not required. However, in this type the ink tank, an ink supply passage, a filter and the like must be disposed in a limited space, i.e., on a carriage. That is, freedom in structural design is suppressed. Therefore, particularly it would be technically difficult to avoid air bubbles which likely generate when ink is supplied from the ink tank to the print head unit or eliminate the air bubbles once occurred. Further, when the ink tank is mounted on the carriage manually, unintentional accidents like a mechanical damage to the peripheral devices may occur or air bubble may enter the ink tank.

Further, filling fluid is required to be filled in the ink supply passages of the print head unit at the time of the off-the-shelf to avoid problems caused by air bubbles which may generate when ink is initially filled in the passages.

SUMMARY OF THE INVENTION

The present invention was made in view of the foregoing difficulties accompanying the conventional ink-jet recording apparatus of the on-carriage type. Therefore, an object of the invention is to provide an ink-jet type recording apparatus in which a print head and an ink tank are mounted on a carriage, capable of exhausting air bubbles immediately after they are generated, reducing a possibility of unintentional accidents, and supplying ink even in case where a positional deflection presents between the ink tank and the print head unit.

It is another object of the invention to provide an ink-jet type recording apparatus capable of controlling generations of air bubbles in an ink supply passage from the ink tank to the print head.

The above and other objects can be achieved by a provision of an ink-jet type recording apparatus which, according to the present invention, includes a connecting member which is provided with a first ink supply passage disposed in a carriage and extending in parallel toward a print head unit and a second ink supply passage extending upwardly and communicated with the ink tank and the first ink supply passage, an ink head unit connected to the connecting member for jetting ink droplets corresponding to print signals, a hollow needle engaging with a needle insertion hole of the ink tank, a filter member provided in parallel with a tapered concave portion formed between the hollow needle and the second ink supply passage, a cap member detachably mounted on the print head unit for communicating with a suction pump, and a control member for driving the suction pump in a first suction mode which operates intervally and a second suction mode which operates continuously.

After mounting the ink tank onto the carriage, when ink is supplied to the print head unit, the ink flows through the filter member smoothly under the first suction mode thereby to suppress the occurrence of air bubbles by the filter member. Since the filter member is disposed between an upper and lower tapered concave members the air bubbles generated in this area moves along inclined surface of the concave member toward the ink tank so that the air bubbles do not flow into the print head unit.

DESCRIPTION OF THE PREFERRED EMBODIMENTS

The preferred embodiments of the present invention will now be described in detail with reference to accompanying drawings.

Figure 1:
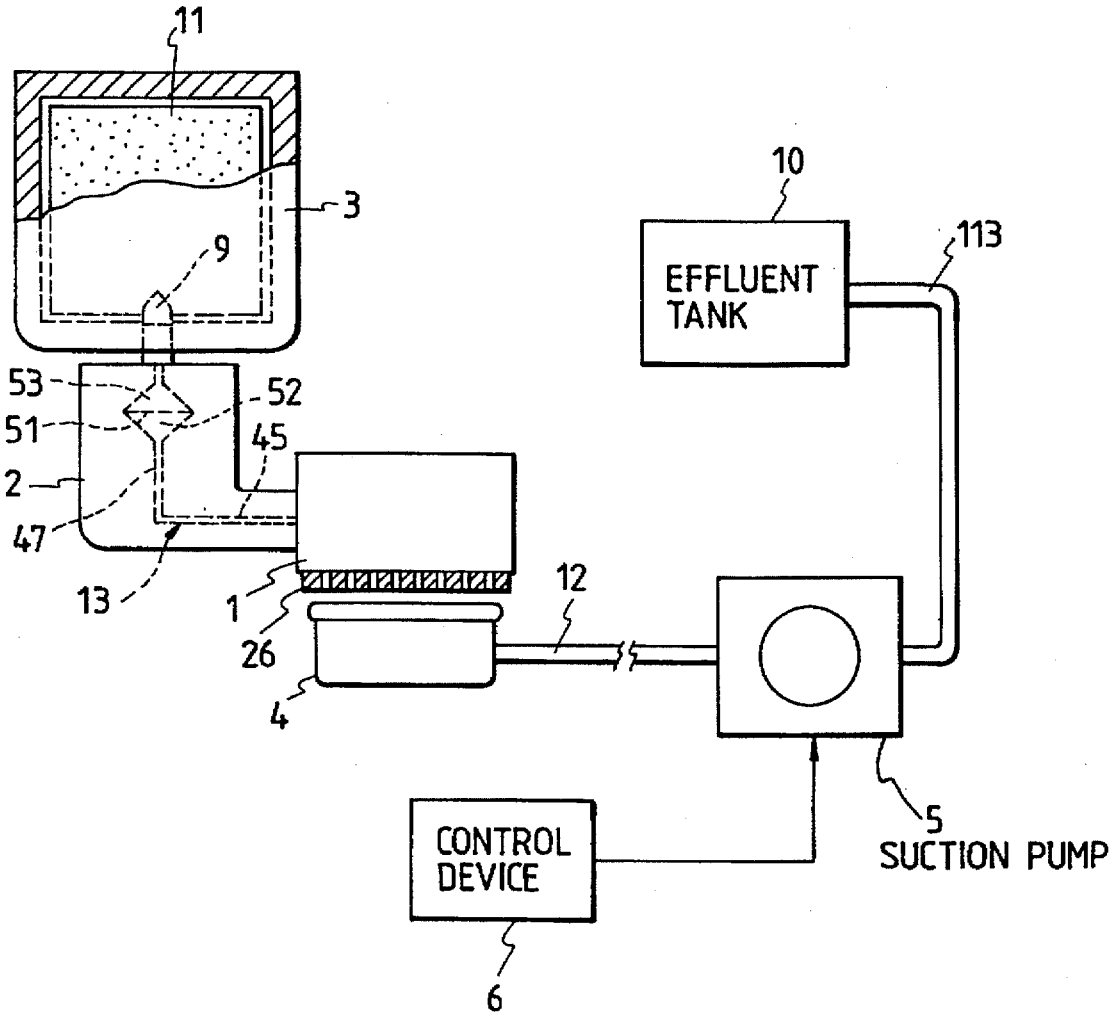
FIG. 1 is a schematic view showing an ink supply system of an ink-jet type recording apparatus according to one embodiment of the present invention.

FIG. 1 is a schematic view showing one embodiment of the present invention. A print head unit 1 of an ink-jet type connects to an ink tank 3 through a connecting member 2. Ink which is impregnated in a foam member 11 accommodated within the ink tank 3 is supplied to the print head unit through a hollow needle 9 and an ink supply passage 13 defined in the connecting member 2, so that the print head unit 1 emits ink droplets in accordance with print signals.

Figure 2:
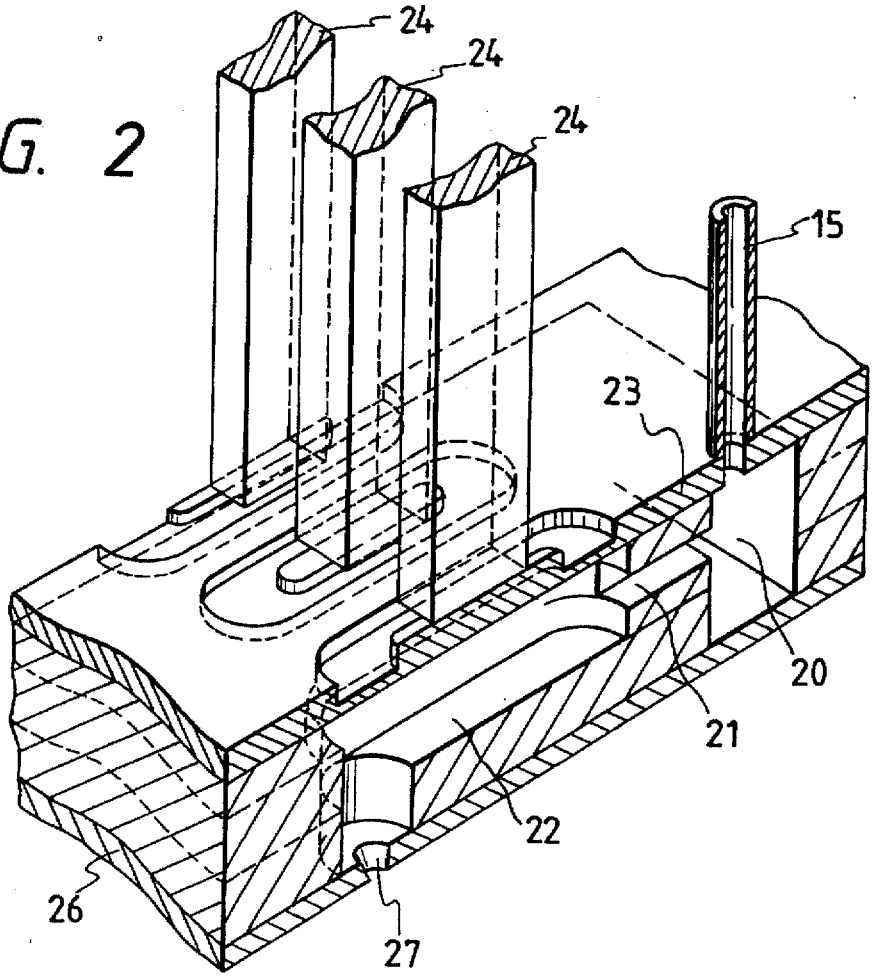
FIG. 2 is a perspective view showing one example of the print head unit illustrated in FIG. 1.

FIG. 2 is a perspective view showing one example of the print head unit 1 illustrated in FIG. 1. The ink is flown to a reservoir 20 through a rising conduit 15 coupled to the ink supply passage 13, and the reservoir 20 supplies through an ink supply port 21 ink therein by an amount consumed by each of a pressure generating chamber 22. A vibrating plate 23 seals the pressure generating chambers 22, and an end of each piezoelectric vibrating members 24, 24, 24 . . . abuts against the vibrating plate 23 at a position corresponding to the respective pressure generating chambers 22, 22, 22 . . . . Each of the piezoelectric vibrating members 24, 24, 24 . . . expands and shrinks in response to the print signal so that the volume of each of the pressure generating chambers 22 is decreased and increased, thereby to suck ink from the reservoir 20 to the pressure generating chamber 22 or emit the ink droplets from nozzle openings 27 formed on a nozzle plate 26.

Referring now back to FIG. 1, the apparatus of the invention also includes a cap member 4 disposed at non-printing area, which cap member comes into abutment against the nozzle plate 26 of the print head unit 1 by a drive mechanism (not shown) for preventing the nozzle openings 27, 27, 27 . . . from drying. The cap member 4 connects through a tube 12 to a suction pump 5 which is operated by a control device 6 to suck corrected ink in the cap member 4. The suction pump 5 may be of a so-called tube pump type in which a plurality of rollers arranged on a support member spaced apart from one another on a common periphery thereof abut elastically against an elastic tube arranged circularly, and the support member is rotated in one direction by a direct current motor. The apparatus shown in FIG. 1 is also provided with an effluent tank 10 connected to an outlet port of the suction pump 5 through a tube 113.

Figure 3:
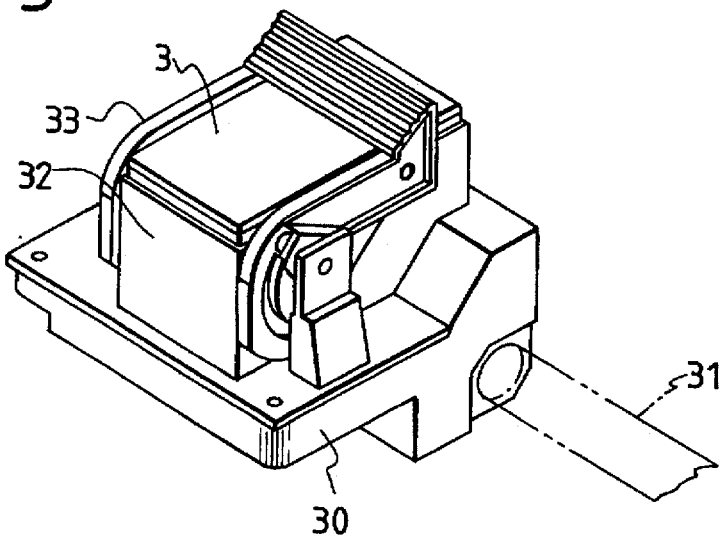
FIG. 3 is a perspective view showing one embodiment of the carriage on which the print head unit and the ink tank are mounted.

FIG. 3 is a perspective view showing one embodiment of the carriage on which the print head unit and the ink tank are mounted. A carriage 30 reciprocally moves along a platen (not shown) guided by a guide lock 31. An ink tank holder 32 is disposed on an upper surface of the carriage 30 for holding the ink tank 3. A lever 33 is rotatably supported on the holder 32 for holding and securing the ink tank 3 by engaging with an engagement section of the ink tank 3.

Figure 4:
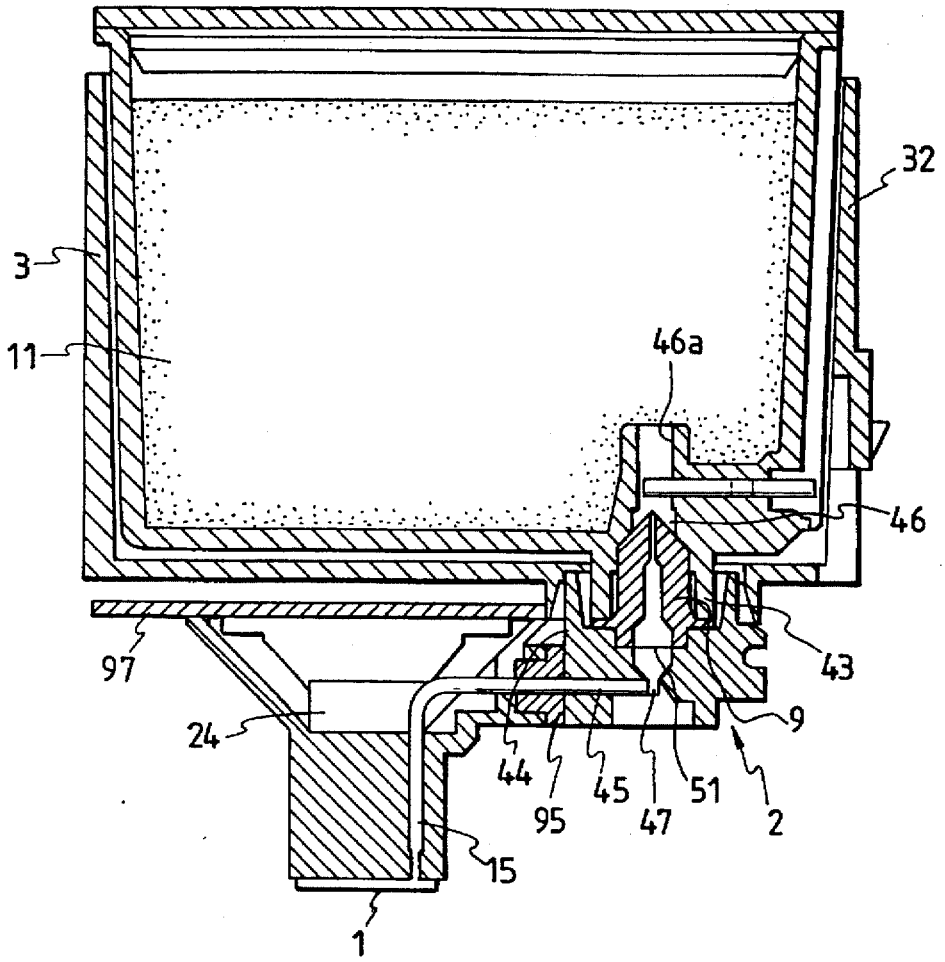
FIG. 4 is a sectional view showing a state of the print head unit according to the present invention.

FIG. 4 is a sectional view showing a state where the print head unit 1, the carriage 30 and the connecting member 2 connected therebetween. The connecting member 2, especially an elastic joint 95 thereof is disposed between the ink tank 3 and the print head unit 1 for preventing a downward force of the ink tank 3 from largely transferring to the print head unit 1 when the ink tank 3 is mounted on the carriage 30, and absorbing the positional deflection created therebetween. Therefore, the ink tank 3 and the print head unit 1 are affirmly engaged therewith.

The ink supply port 46 has a wall **46*a* projecting inward of the housing of the ink tank 3 and compressing the foam member 11 in the vicinity of the ink supply port 46. Since the pore size of the foam member 11 which is compressed by the wall 46*a* of the ink supply port 46 is smaller than that of the other part, the capillary force of the foam member 11 in the vicinity of the ink supply port 46 is large compared to the other portion thereof. Accordingly, ink which is impregnated in the foam member 11 is gathered toward the ink supply port 46 so that ink can be consumed up to the last drop. The wall 46*a* of the ink supply port 46 is located close to and spaced from the wall of the ink tank housing as shown in FIG. 4**.

Figure 5:
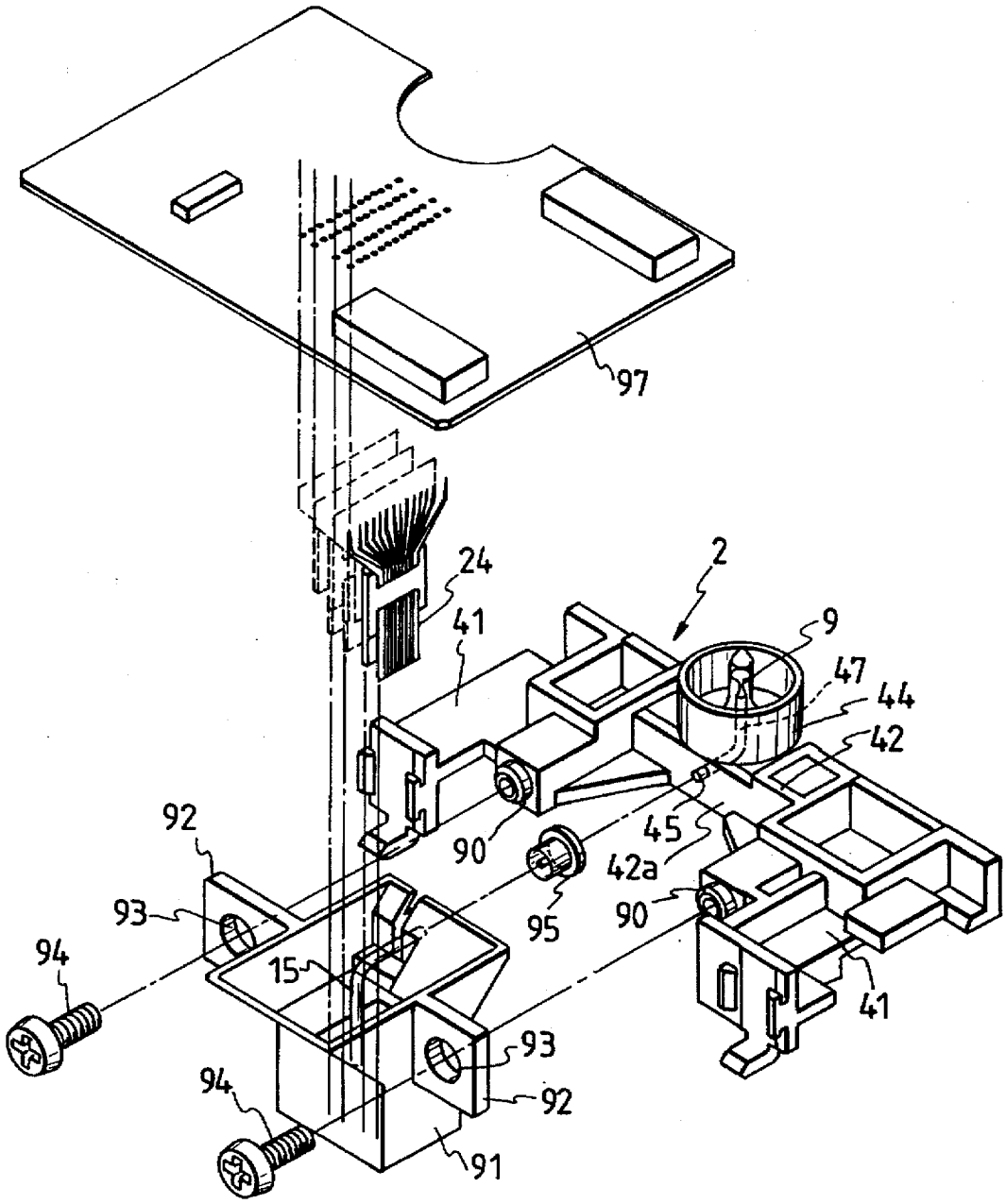
FIG. 5 is a perspective view showing a structure of a carriage according to the present invention.

As shown in FIG. 5, the connecting member 2 is generally U-shaped and provided with a body 42 and a pair of leg portions 41, 41 disposed at both sides of the body 42. A cylinder body 44 for receiving a connecting conduit 43 of the ink tank 3 is formed on an upper center of the body 42 between the leg portions 41 and 41. A first ink supply path 45 directing substantially in parallel with respect to the recording apparatus connects an inner side surface **42*a* of the body 42 to the center of the cylinder body 44. A hollow needle 9 projects upward from a center part of the cylinder body 44 and communicates with the ink supply path 45. The hollow needle 9 penetrates the ink supply port 46 of the ink tank 3**.

Figure 6:
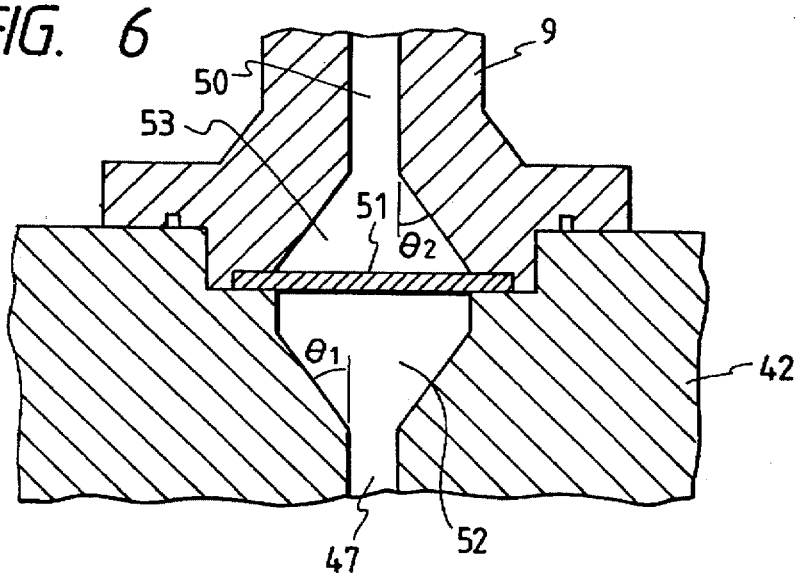
FIG. 6 is an enlarged sectional view showing a filter member.

As shown in FIG. 6, a through hole 50 of the needle 9 communicates with the first ink path 45 through a second ink supply path 47 directing substantially in vertical with respect to the recording apparatus. A filter member 51 is arranged in a flow passage connecting between the hollow needle 9 and the second ink supply path 47. Specifically, the filter member 51 positions between a tapered concave portion 52, an upper portion of which is widened, formed in the connecting member body and a tapered concave portion 53, a lower portion of which is widened, formed below the hollow needle 9. The filter member 51 is laid in and perpendicular to a vertical ink supply passage communicating between the through hole 50 of the hollow needle 9 and the second ink supply path 47. The filter member 51 is formed of SUS fine wires by twill weaving to approximately 2000 mesh.

The taper angles θ1 and θ2 of the concave portion 52 and 53, respectively, are defined within a range between substantially 30° and 60°. These angles are selected to have a function to efficiently lead air bubbles within the concave portions 52 and 53 to move upward therealong.

Figure 7A:
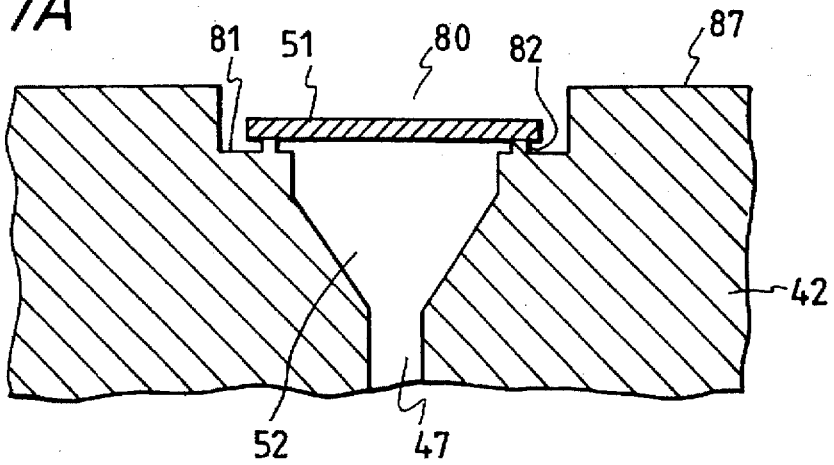
FIGS. 7A, 7B and 7C show a process of assembling the filter member.
Figure 7B:
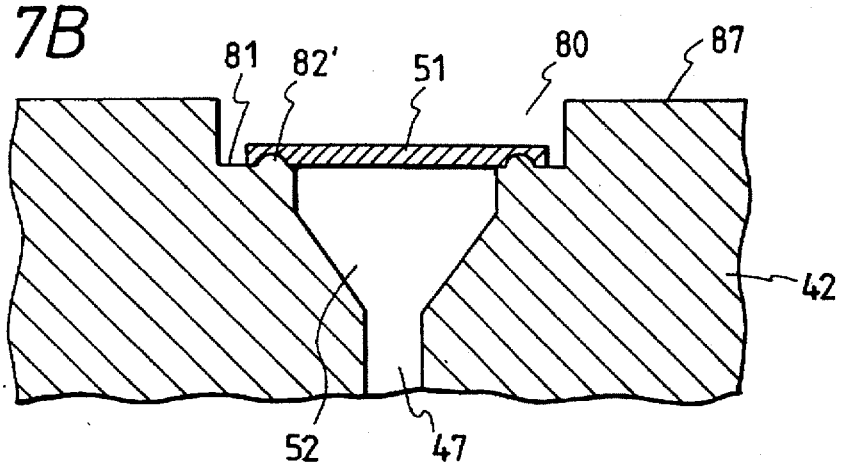
Figure 7C:
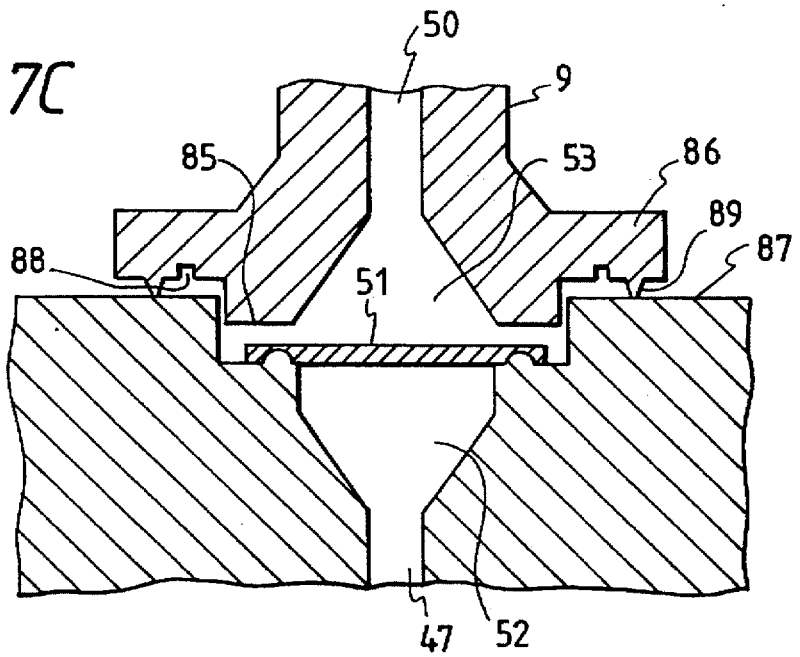

FIGS. 7A, 7B and 7C show a process of assembling the filter member 51. A concave 80 formed at an opening part of the tapered concave portion 52 formed on the connecting member body **42*a* is designed to have a diameter engageable with a bottom of the hollow needle 9. The tapered concave portion 52 is formed at the center of the concave 80. A ring-like protrusion 82 is formed on a step part 81 to surround the tapered concave portion 52**.

The filter member 51 is laid on the ring-like protrusion 82 as shown in FIG. 7A. Under this condition, a heat is applied to the protrusion 82 through the filter member 51 so that a fusing part 82' of the protrusion 82 is selectively fused to penetrate into the mesh of the filter member 51 as illustrated in FIG. 7B.

On the other hand, the hollow needle 9 is provided with a flange 86 contacting an upper surface 87 of the connecting member body 42 in the vicinity of a bottom 85 thereof which is engageable with the concave 80 of the connecting member body 42. The flange 86 is provided with an annular groove 88 on the bottom surface thereof and an annular protrusion 89 which is V-shaped in cross section. The annular protrusion 89 is disposed at an outer side of the annular groove 88.

Next, the hollow needle 9 is inserted in the concave portion 52 on which the filter member 51 is fuse bonded as shown in FIG. 7C. Then an ultrasonic rays are applied to the flange 86 so that the protrusion 89 is selectively fused to thereby fuse bond to the connecting member body 42. During the fusion process, the remained part of the protrusion 89 flows into the annular groove 88. Accordingly, the remained part would not be forced out of the flange 86. As a result, the filter member 51 is secured air-tightly between the connecting member body 42 and the hollow needle 9.

The leg portions 41, 41 of the connecting member 2 is provided with a pair of positioning pegs 90, 90 projecting from a center of the inner side thereof, which pegs engage with mounting holes 93 formed on flange portions 92 extending from both the sides of a head base body 91. The pegs 90 and the mounting holes 93 are finally secured integrally by screws 94.

One end of the rising conduit 15 of the print head unit 1 faces the head base body 91 at a portion corresponding to the ink passage of the connecting member 2. The rising conduit 15 communicates with the first ink supply path 45 of the connecting member 2 through the elastic joint 95. As shown in FIG. 5, the apparatus also includes a circuit substrate 97 fixed onto an upper surface of the head base body 91.

In the embodiment described above, when the ink tank 3 is installed on the carriage 30 and the lever 33 is pulled down, the hollow needle 9 enters the connecting conduit 43 of the ink tank 3. Under this condition, when the cap member 4 is mounted on the print head unit 1 and the suction pump 5 is actuated, the suction force by the pump 5 is applied to the nozzle openings 27, 27, 27 . . . through the cap member 4. This vacuum pressure is then applied to the ink tank 3 through the first ink supply path 45, the filter member 51, the second ink supply path 47 and the hollow needle 9, so that the ink impregnated in the foam member 11 is forced into the ink flow passages.

Figure 8:
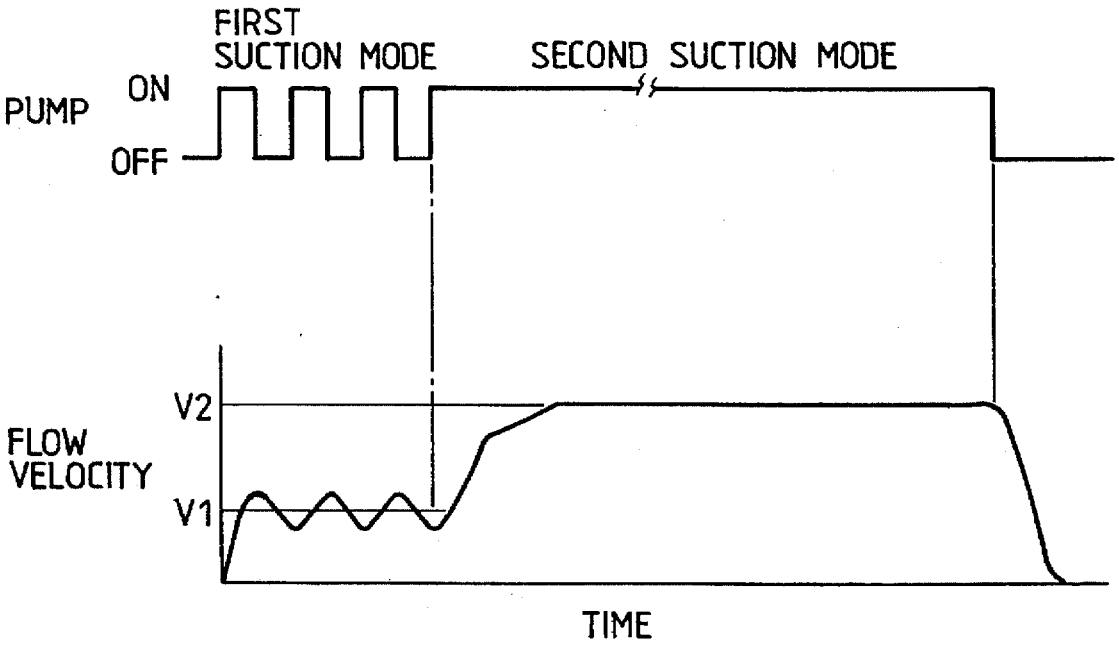
FIG. 8 is a time chart showing an interval suction operation and continuous suction operation according to the present invention.

FIG. 8 is a time chart showing an interval suction operation and continuous suction operation described hereinbelow according to the present invention.

After a certain time period within a range between 0.1 and 1 second, for example, has lapsed, the pump is once deactivated thereby stopping the suction operation. After that, at a stage where a certain time period within a range between 0.1 and 1 second, for example, has lapsed, the pump is actuated again to suck ink from the foam member 11.

Figure 9A:
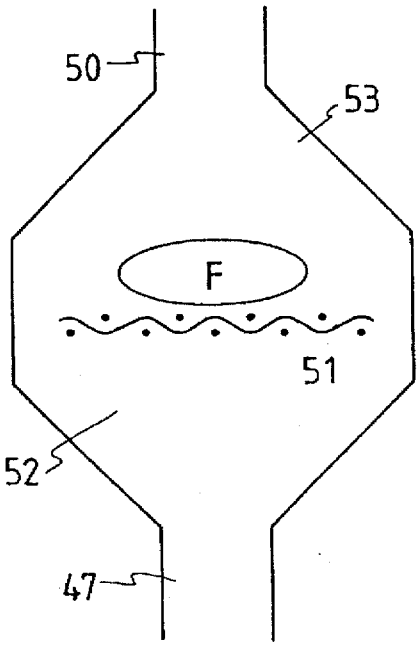
FIG. 9A, 9B, 9C and 9D are schematic views showing states of ink flow and air bubbles.
Figure 9B:
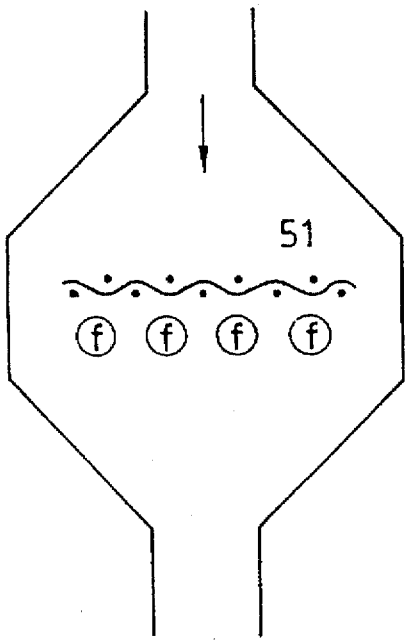
Figure 9C:
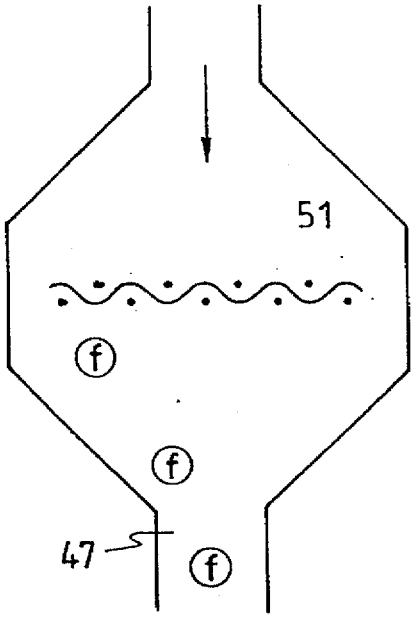

By the interval suction operation by actuating and deactivating the suction pump 5 intervally, the flow velocity V1 of the ink flowing through the ink supply passages is much suppressed to be slower than 1 mm/second, also the flow rate of which is also much suppressed to be equal to or smaller than 0.01 cc/second. As a result, the ink passes through the filter member 51 smoothly and, accordingly, the occurrence of generating air bubbles by the mesh of the filter member 51 is effectively avoided. Even if air bubbles F are generated as shown in FIG. 9A, the bubbles are broken by the mesh of the filter member 51 when passing therethrough as illustrated in FIG. 9B. Then, small air bubbles f, f, f . . . flow to the print head unit 1 from the ink supply path 47 as shown in FIG. 9C.

By repeating the interval suction operations, ink is filled in the flow passages communicating from the ink tank 3 to the print head unit 1. At a stage after ink is fully filled in the whole passages from the ink tank 3 to the print head unit 1, when the suction pump 5 is continuously actuated for between 2 to 10 seconds, ink flows at a high speed V2, for example a flow amount at this stage is approximate to 0.2 cc/sec. from the ink tank 3 to the print head unit 1. In this operation, the small air bubbles driven to the print head unit 1 or adhered on a wall surface of the flow passages are also flown to the head unit 1 by the high speed flow of ink and then exhausted into the cap member 4 through the nozzle openings 27. During the continuous suction operation, since the whole ink supply passages have been filled with ink, no air bubbles generate.

After filling ink in all the ink supply passages, when print signals are output to the print head unit 1, ink droplets are emitted onto a recording sheet in accordance with the recording signals by means of a known operation. Amount of ink consumed by the print head unit is refilled from the ink tank 3 through the ink supply passages.

As described above, since the flow velocity of ink is preset much slow at an initial stage of the filling, the possibility of generating air bubbles is suppressed even in case where the ink supply passages are filled with no ink. Accordingly, filling fluid which is conventionally filled in the ink supply passages of the print head unit at the time of the off-the-shelf is not required in the present invention.

Further, even in case where an ink tank impregnating ink which is not subjected with air removing treatment is installed on a carriage, no air bubbles are remained in the ink supply passages after fully filling the ink.

Figure 9D:
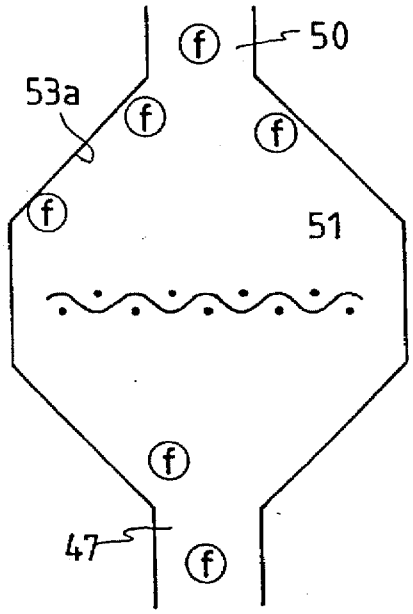

In the step of filling ink, the air bubbles flowing from the ink tank 3 to the hollow needle 9 moves upward along a tapered wall 53*a* of the concave portion 53 defining the filter chamber as shown in FIG. 9D. Accordingly the air bubbles do not enter the ink supply path 45 extending substantially in parallel with respect to the recording apparatus. Further, small dust or small particles of the foam member 11 which may be flown out of the ink tank 3 is trapped by the filter member 51 and would not enter the print head unit 1.

The effect of the interval suction operation of the suction pump as described above becomes the highest when the paused duration of the suction operation is set from approximately 0.2 to 0.5 second. Further, at a stage where all ink within the ink tank 3 is consumed during the printing, if the ink tank 3 is exchanged the control device 6 controls the suction pump 5 to operate the first interval suction operation and then the second continuous suction operation to fill new ink to the print head unit 1 as described above.

As described above, an ink-jet type recording apparatus according to the present invention includes a connecting member which is provided with a first ink supply passage disposed in a carriage and extending in parallel toward a print head unit and a second ink supply passage extending upwardly and communicated with the ink tank and the first ink supply passage, an ink head unit connected to the connecting member for jetting ink droplets corresponding to print signals, a hollow needle engaging with a needle insertion hole of the ink tank, a filter member provided in parallel with a tapered concave portion formed between the hollow needle and the second ink supply passage, a cap member detachably mounted on the print head unit for communicating with a suction pump, and a control member for driving the suction pump in a first suction mode which operates intervally and a second suction mode which operates continuously. Therefore, after mounting the ink tank onto the carriage, when ink is supplied to the print head unit, the ink flows through the filter member smoothly under the first suction mode thereby to suppress the occurrence of air bubbles by the filter member. Since the filter member is disposed between an upper and lower tapered concave members the air bubbles generated in this area moves along inclined surface of the concave member toward the ink tank so that the air bubbles do not flow into the print head unit.

Further, since the apparatus of the invention includes the connecting member for connecting the ink tank to the print head unit so that the print head unit is mounted on the carriage in parallel direction, the ink tank can be assembled onto the carriage without applying a strong force to the print head unit which is accurately and sensitively assembled. Furthermore, the ink tank can be interconnected to the print head unit under a condition where the undesirable positional deflection which deteriorates the quality of emitting the ink droplets can be suppressed as small as possible.

Moreover, since the elastic joint is disposed between the connecting member and the print head unit and a sealing portion disposed on one surface thereof covers and seals the ink passage opening, the print head unit can be accurately assembled to communicate with the connecting member in spite of positional deflection between them, by simply mounting the print head unit onto the connecting member.

Although the foregoing embodiment show a uni-color type recording apparatus in which a single ink tank is employed, the invention is not limited thereto or thereby. For example, the invention can be applied to a color type recording apparatus in which four ink tanks each of which contains ink of cyan, mazenta yellow and black. In this type, the structure and function of each of the ink tank, carriage, print head unit and connecting member are the same as those shown in the embodiment described above.

What is claimed is:

1. An ink-jet type recording apparatus comprising:

a carriage moving reciprocally along a platen of the recording apparatus;

a print head unit mounted on said carriage;

an ink tank mounted on said carriage for containing ink;

means mounted on said carriage for connecting said ink tank to said print head unit, said connecting means comprises:

first ink supply path extending horizontally from said print head unit of the recording apparatus and disconnectably connecting to said print head unit; and second ink supply path providing fluid communication between said ink tank and said first ink supply path, means connected to said second ink supply path for supplying ink from said ink tank, said first ink supply path defining with said second ink supply path a tapered concave chamber; and means disposed in said tapered concave chamber for filtering the ink.

2. An ink-jet type recording apparatus comprising:

a carriage moving reciprocally along a platen of the recording apparatus;

a print head unit mounted on said carriage;

an ink tank mounted on said carriage for containing ink;

means mounted on said carriage for connecting said ink tank to said print head unit, said connecting means comprises:

first ink supply path extending horizontally from said print head unit of the recording apparatus and disconnectably connecting to said print head unit; and second ink supply path providing fluid communication between said ink tank and said first ink supply path, means connected to said second ink supply path for supplying ink from said ink tank, said first ink supply path defining with said second ink supply path a tapered concave chamber; and means disposed in said tapered concave chamber for filtering the ink;

wherein said connecting means comprises an elastic joint through which said first ink supply path and said print head unit are connected to each other.

3. The ink-jet type recording apparatus of claim 1, wherein said ink supply means comprised a hollow needle penetrating said ink tank.

4. The ink-jet recording apparatus of claim 3, wherein said hollow needle is separately provided and fuse bonded to said connecting means.

5. An ink-jet type recording apparatus comprising:

a carriage moving reciprocally;

a print head unit mounted on said carriage, said print head unit emitting ink droplets in response to print signals;

an ink tank mounted on said carriage for containing ink;

means mounted on said carriage for connecting said ink tank to said print head unit, said connecting means comprises:

first ink supply path extending horizontally from said print head unit of the recording apparatus and disconnectably connecting to said print head unit; and second ink supply path providing fluid communication between said ink tank and said first ink supply path, said second ink supply path extending vertically upward with respect to said print head unit of the recording apparatus, means connected to said second ink supply path for supplying ink from said ink tank, said first ink supply path defining with said second ink supply path a tapered concave chamber; and means disposed in said tapered concave chamber for filtering the ink, said filtering means being horizontally oriented;

a suction pump;

a cap means detachably mounted on said print head unit and connecting to said suction pump; and a control means for driving said suction pump in a first mode where said suction pump is actuated intervally and a second mode where said suction pump is actuated continuously.

6. The ink-jet type recording apparatus of any one of claim 1 or 5, wherein said filtering means is formed of SUS fine wires by twill weaving to approximately 2000 mesh.

7. The ink-jet type recording apparatus of any one of claim 1 or 5, wherein said connecting means comprises a first tapered concave member an upper portion of which is widened and said ink supplying means comprises a second tapered member a lower portion of which is widened, said first and second concave members defines said tapered concave chamber.

8. The ink-jet type recording apparatus of claim 7, wherein tapered angles of said first and second concave members are defined within a range between substantially 30° and 60°.

9. The ink-jet type recording apparatus of any one of claim 1 or 5, wherein said filtering means is fuse bonded onto said connecting member.

10. The ink-jet type recording apparatus of claim 5, wherein under said first mode said suction pump is actuated for a period within a range between 0.1 and 1 second, deactivated for a period within a range between 0.1 and 1 second, and actuated again.

11. The ink-jet type recording apparatus of claim 10, wherein said suction pump is actuated for a period within a range between 0.2 and 0.5 second.

12. The ink-jet type recording apparatus of claim 5, wherein under said second mode said suction pump is actuated for a period from 2 to 10 seconds.

13. The ink-jet type recording apparatus of claim 5, wherein ink flows at a first flow rate under said first mode and flows at a second flow rate under said second mode, and said first flow rate is smaller than said second flow rate.

14. The ink-jet type recording apparatus of claim 13, wherein said first flow rate is equal to or smaller than 0.01 cc/sec., and said second flow rate is approximately 0.2 cc/sec.

15. The ink-jet type recording apparatus of claim 5, wherein said suction pump is of a tube type.

16. The ink-jet type recording apparatus of claim 5, further comprising an effluent tank connected to an outlet port of said suction pump.

17. The ink-jet type recording apparatus of any one of claim 1 or 5, further comprising a foam member accommodated in said ink tank.

18. The ink-jet type recording apparatus of claim 17, wherein said ink tank comprises a wall projecting inside for compressing said foam member.

19. A method of filling ink in ink supply passages of an ink-jet type recording apparatus at an initial stage of mounting an ink tank, comprising steps of:

assembling a print head unit comprising nozzle openings onto a carriage;

mounting an ink tank filled with ink on said print head unit through a connecting member comprising an empty ink supply passage;

intervally actuating a suction pump for applying a suction force to said nozzle openings of said print head unit, so that ink allows to flow into said empty ink supply passage; and continuously actuating said suction pump.

20. The ink filling method of claim 19, wherein an ink flow rate during the intervally sucking step is smaller than that during the continuously sucking step.

21. The ink filling method of claim 20, wherein the ink flow rate during the intervally sucking step is equal to or smaller that 0.001 cc/second, and the ink flow rate during the continuously sucking step is approximately 0.2 cc/second.

22. The ink filling method of claim 19, wherein said interval suction step comprises steps of:

actuating the suction pump for a time period within a range between 0.1 to 1 second;

deactivating the suction pump for a time period within a range between 0.1 to 1 second;

actuating the suction pump again; and repeating a several-times said actuating, deactivating and actuating again the suction pump steps.

23. The ink filling method of claim 22, wherein said deactivating period of the suction pump is within a range between 0.2 and 0.5 second.

24. The ink filling method of claim 19, further comprising a step of disposing a filter member in said ink flow passage at a tapered concave chamber thereof.

25. The ink filling method of claim 24, wherein tapered angles of said tapered concave chamber is defined within a range between substantially 30° and 60°.

26. The ink filling method of claim 24, wherein said filter member is fuse bonded in said concave chamber to said connecting member.

27. The ink filling method of claim 19, wherein said ink tank accommodates therein a foam member impregnating ink.

28. The ink filling method of claim 22, wherein said foam member is compressed in the vicinity of an ink supply port of said ink tank projecting inward thereof.

29. The ink filling method of claim 19, further comprising a step of exhausting corrected ink to an effluent tank connected to the suction pump.

30. The ink filling method of claim 19, wherein the suction chamber is of a tube type.

31. An ink-jet type recording apparatus comprising:

a carriage moving reciprocally;

a print head unit mounted on said carriage, said print head unit emitting ink droplets in response to print signals;

an ink tank mounted on said carriage for containing ink; and a flow passage connecting said ink tank to said print head unit, said flow passage comprising:

a first tapered concave portion having a first taper angle and a second tapered concave portion having a second taper angle;

a filter portion having a filter member, said filter portion positioned between said first tapered concave portion and said second tapered concave portion while sandwiching said filter member;

a first ink supply path communicating with said ink tank and said first tapered concave portion; and a second ink supply path communicating with said second tapered concave portion and said print head unit.

32. The ink-jet type recording apparatus according to claim 31, wherein each of said first taper angle and said second taper angle is within the range of about 30 to 60 degrees.

33. The ink-jet type recording apparatus according to claim 31, wherein said first ink supply path being disposed substantially perpendicular to said filter member.

34. The ink-jet type recording apparatus according to claim 31, wherein said first ink supply path comprises an ink supply needle for communicating with said ink tank.

35. The ink-jet type recording apparatus according to claim 31, wherein said filter member is positioned horizontally.

* * * * *